US007269381B2

(12) United States Patent
Okuda et al.

(10) Patent No.: US 7,269,381 B2
(45) Date of Patent: Sep. 11, 2007

(54) DEVELOPING APPARATUS

(75) Inventors: Akinobu Okuda, Toyonaka (JP); Kazumasa Hayashi, Kobe (JP); Akinori Toyoda, Katano (JP); Masao Ootsuka, Sakai (JP); Hideki Yasuda, Toyonaka (JP); Naoki Takahashi, Kyotanabe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 313 days.

(21) Appl. No.: 11/148,640

(22) Filed: Jun. 9, 2005

(65) Prior Publication Data

US 2005/0281588 A1 Dec. 22, 2005

(30) Foreign Application Priority Data

Jun. 11, 2004 (JP) ..... 2004-173520

(51) Int. Cl.
*G03G 15/08* (2006.01)

(52) U.S. Cl. ..... 399/254

(58) Field of Classification Search ..... 399/254, 399/255, 256, 258

See application file for complete search history.

(56) References Cited

U.S. PATENT DOCUMENTS

| | | | | |
|---|---|---|---|---|
| 4,940,014 | A * | 7/1990 | Saijo et al. | 399/256 |
| 5,758,240 | A * | 5/1998 | Ito et al. | 399/267 |
| 5,991,583 | A * | 11/1999 | Nozawa | 399/254 |
| 6,343,200 | B1 * | 1/2002 | Hatano et al. | 399/254 |

FOREIGN PATENT DOCUMENTS

| | | | |
|---|---|---|---|
| EP | 0 819 993 | | 1/1998 |
| JP | 10-31363 | | 2/1998 |
| JP | 10123818 | A * | 5/1998 |
| JP | 10177299 | A * | 6/1998 |

* cited by examiner

*Primary Examiner*—Robert Beatty
(74) *Attorney, Agent, or Firm*—Hamre, Schumann, Mueller & Larson, P.C.

(57) ABSTRACT

The developing apparatus of the present invention includes a developer holding member for supplying a developer including a toner and a carrier onto the surface of an electrostatic latent image holding member; first developer transporter for transporting the developer in a first direction, the first developer transporter being disposed in a first developer transport path; second developer transporter for transporting the developer in a second direction that is opposite to the first direction and supplying the developer to the developer holding member, the second developer transporter being disposed in a second developer transport path; a magnet roller for drawing up the developer that has been transported through the second developer transport path into the first developer transport path; and an inclined surface that is disposed in contact with or close to the surface of the magnet roller and that is inclined such that the height thereof decreases along the first direction, wherein the developer that is held on the magnet roller is detached by the inclined surface, and the detached developer is transported in the first direction, and wherein a space in the first developer transport path that surrounds the magnet roller has a portion having a cross-sectional open area larger than that of a space in the first developer transport path that surrounds the first developer transporter.

7 Claims, 6 Drawing Sheets

DEVELOPING APPARATUS

BACKGROUND OF THE INVENTION

1. Field of the Invention

The present invention relates to developing apparatuses used for image forming apparatuses such as copiers, printers, and facsimiles.

2. Description of the Related Art

Conventionally, electrophotographic image forming apparatuses optically scan an original image portion, which is an outer circumferential surface of a uniformly charged photosensitive drum, to form an electrostatic latent image and this electrostatic latent image is visualized using a toner, which is a colored resin. Such image forming apparatuses are capable of forming an image at a high speed and thus have been used widely in digitized printers and copiers, for example.

In recent years, there have been increasing demands particularly for forming images in color, and also in the electrophotographic image forming apparatuses, image forming apparatuses for forming a full color image consisting of toner images of four colors, cyan, magenta, yellow, and black, have been realized. In such image forming apparatuses, there has been recently an increasing demand for reducing the size of the body of the apparatuses in order to achieve space-saving, in addition to demands for increasing the speed and the image quality.

On the other hand, as a developer used for development of the electrostatic latent image, two-component developers constituted by a carrier and a toner, with which a high image quality and a low running cost can be realized, have been used widely. In this case, the electrostatic latent image that is formed on the surface of the drum is developed, using a developing apparatus provided with a development sleeve having magnets disposed therein, by rubbing the developer in the form of a magnetic brush against the surface of the photosensitive drum.

In such a developing apparatus, two screws are disposed horizontally in the developing apparatus, and homogenous mixing of the toner and the carrier and frictional charging of the toner can be performed sufficiently by circulating the developer between these two screws.

In this configuration, since the two screws are disposed in the horizontal direction, the developing apparatus was enlarged transversely when viewed from a cross section in a direction that is orthogonal to the shafts of the screws. Thus, there has been a problem in that when such a developing apparatus is used for a 4-drum tandem type image forming apparatus in which image forming units corresponding to various toner colors are disposed side by side in the transverse direction, the spacing between adjacent photosensitive drums is increased and thus the size of the body of the image forming apparatus is increased.

As a developing apparatus for solving this problem, for example, JP H10-31363A discloses a developing apparatus employing a vertically circulating system. In this developing apparatus, a development housing in which a development sleeve is accommodated is partitioned into an upper part and a lower part. The development sleeve is disposed in the lower part, and a screw is provided in each of the upper part and the lower part along the axial direction of the development sleeve, with the screws delivering the developer in opposite directions.

Furthermore, accumulation of the developer in a drawing-up portion and stress imposed on the developer, which are caused by drawing up the developer from the screw in the lower part to the screw in the upper part against gravity, are prevented by drawing up the developer using a magnet roller. In this way, the developing apparatus in which the developer is transported smoothly in the vertical direction and the width of the cross section of the apparatus is narrower in the direction that is orthogonal to the shafts of the screws is realized.

However, in the conventional developing apparatus employing a vertically circulating system as described above, the developer is transported by the screw provided in the upper part, immediately after the developer is drawn up. For this reason, the ability to mix the developer in the drawing-up portion is poor, so that it takes much time to render the developer uniform, the toner density of which has been made uneven through development.

Moreover, depending on the timing of toner replenishment, which is performed downstream of the drawing-up portion, the unevenness of the toner density of the developer may be promoted even more.

On the other hand, if the size of the developing apparatus is further reduced, the time for stirring the developer during each cycle of circulation is reduced, and furthermore, the capacity of the screw to stir the developer also is decreased with a reduction in the diameter of the screws. That is to say, a reduction in size leads to a problem in that the time needed for uniformly mixing the toner until the toner density is stabilized is increased, and uneven density is likely to occur in an output image.

Moreover, the developing apparatus employing a vertically circulating system as disclosed in the above-mentioned conventional art has a structure in which the developer is drawn up from the lower part into the upper part. For this reason, if the upper part into which the developer is drawn up does not have a sufficient space and sufficient transporting capacity for receiving the developer that has been transported by the screw in the lower part, accumulation and clogging of the developer occur in an end portion of the screw in the lower part.

When the accumulation of the developer is present in a portion on the screw that corresponds to an image printing area, there will be a problem in that the amount of the developer that is formed in a layer on the development sleeve is changed, resulting in an uneven image density.

Moreover, in the accumulation of the developer, great stress is imposed on the developer, which also will result in a problem of deterioration of the developer.

Furthermore, when clogging of the developer occurs, the screws may be broken and the apparatus may no longer function as a developing apparatus, in the worst case.

In particular, when further reductions in the size of the developing apparatus are to be achieved, the amount of the toner in the developing apparatus decreases in proportion to the size of the apparatus, and thus a difference in density between left and right portions of the output image is likely to occur when the toner is consumed through development. In order to prevent such a difference in density from occurring, it is necessary to increase the speed of circulation of the developer. In this case, it also is necessary to increase the speed of drawing-up, so that accumulation and clogging of the developer and deterioration of the developer become more likely to occur.

SUMMARY OF THE INVENTION

The present invention is directed to solving the conventional problems as described above, and it is an object of the present invention to provide a developing apparatus capable of preventing clogging and overflowing of the developer in the drawing-up portion, providing superior ability to uniformly mix the developer after development, and furthermore, stabilizing the toner density in the apparatus within a short period of time after the toner is replenished, and maintaining a stable image quality over a long period of time.

In order to achieve the object, the developing apparatus of the present invention includes: a rotatable electrostatic latent image holding member having a surface on which an electrostatic latent image is formed; a developer holding member for supplying a developer including a toner and a carrier onto the surface of the electrostatic latent image holding member; a first developer transport path that is disposed parallel to the developer holding member; a second developer transport path that is disposed parallel to and below the first developer transport path; communicating holes for communicating the first developer transport path and the second developer transport path with each other, the communicating holes being formed on both end portions of the first and the second developer transport paths; first developer transporter for transporting the developer in a first direction, the first developer transporter being disposed in the first developer transport path; second developer transporter for transporting the developer in a second direction that is opposite to the first direction and supplying the developer to the developer holding member, the second developer transporter being disposed in the second developer transport path; a magnet roller for drawing up the developer that has been transported through the second developer transport path into the first developer transport path, the magnetic roller being disposed above one of the communicating holes that are disposed in the end portions; and an inclined surface that is disposed in contact with or close to a surface of the magnet roller and that is inclined such that the height thereof decreases along the first direction, wherein the developer that is held on the magnet roller is detached by the inclined surface, and the detached developer is transported in the first direction, and wherein a space in the first developer transport path that surrounds the magnet roller comprises a portion having a cross-sectional open area larger than that of a space in the first developer transport path that surrounds the first developer transporter.

BEST MODE FOR CARRYING OUT THE INVENTION

Figure 1:
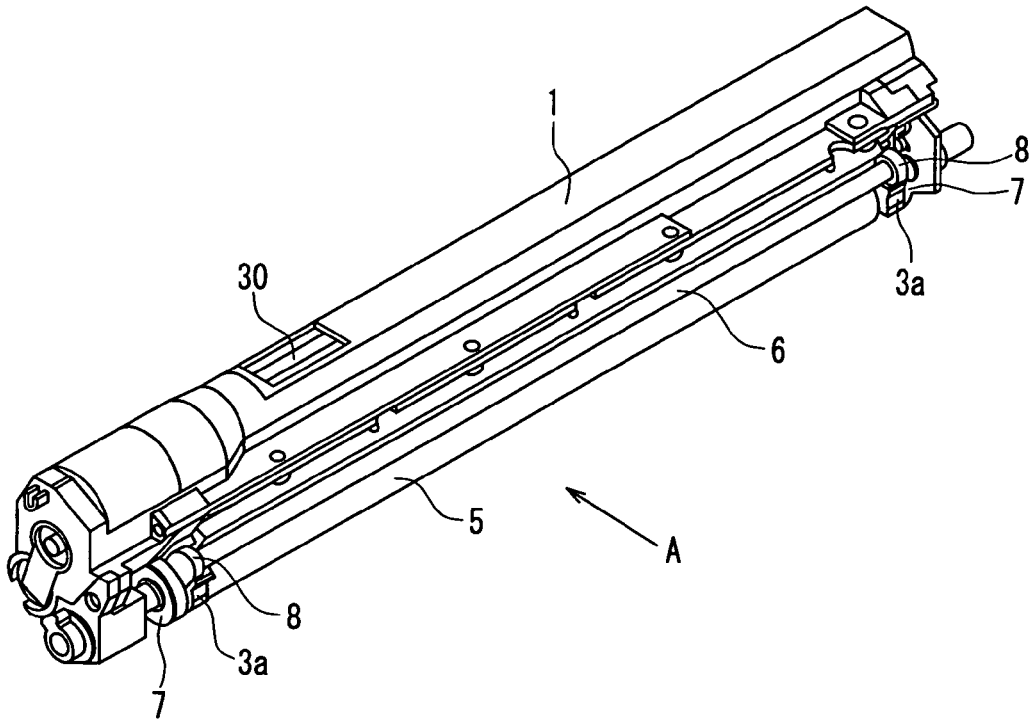
FIG. 1 is a perspective view schematically showing a developing apparatus according to Embodiment 1 of the present invention.

According to the present invention, the space in the developer transport path that surrounds the magnet roller is set to have large dimensions, so that this space can be used as a buffer space in which the developer is allowed to stay temporarily. Furthermore, since the inclined surface that is in contact with or close to the magnet roller is provided, the developer that has been detached onto the inclined surface stays temporarily in the buffer space. Thus, the developer that previously has been detached and the developer that subsequently has been detached can be delivered to downstream of the developer transport path by the inclination of the inclined surface while they are being sufficiently mixed. That is to say, in the buffer space, it is possible to deliver the developer downstream while rendering the density of the developer uniform.

Furthermore, due to the presence of the buffer space, accumulation and clogging of the developer in an end portion of the second developer transport path that is located below the magnet roller, and also uneven image density, deterioration of the developer, and breaking of the screw that may be caused by such accumulation and clogging can be prevented effectively.

In the above-described developing apparatus of the present invention, it is preferable that a space in the first developer transport path that surrounds the first developer transporter near the magnet roller includes a portion having a cross-sectional open area larger than that of the space in the first developer transport path that surrounds the first developer transporter. With this configuration, the density of the developer can be rendered uniform more advantageously.

Moreover, it is preferable that the first and the second developer transporter are screws, and a transporting speed of the developer by the first developer transporter near the magnet roller is smaller than a transporting speed of the developer by the second developer transporter. With this configuration, the developer that has been drawn up is present in the buffer space near the magnet roller and mixed for a longer period of time because of the difference in the transporting speed between the developer transporter, so that the density of the developer after drawing-up can be rendered uniform more advantageously.

Moreover, it is preferable that the toner has a shape factor, SF value, of at most 140. With this configuration, the toner with high sphericity exhibits an effect of reducing the frictional force between toner particles or between the toner and the carrier. Thus, the fluidity of the developer is improved, and the ability to mix the developer in the buffer space near the magnet roller can be improved, that is to say, the uniformity of the density of the developer after drawing-up can be promoted even more. Furthermore, a reduction in the chargeability of the carrier also can be prevented effectively because the shape of the toner tends not to change even under stress and a wax component serving as a parting agent tends not to migrate to the carrier.

Moreover, it is preferable that the carrier is a resin carrier containing a magnetic material and the surface of the resin carrier is coated with fluorine-modified silicone. With this configuration, since the carrier has high lubricity, the adhesion of the carrier to the magnet roller and the frictional force between carrier particles are reduced, so that detachment of the developer from the magnet roller can be stabilized. Thus, the ability to mix the developer in the buffer space near the magnet roller can be improved, so that uniformity of the density of the developer after drawing-up can be promoted even more. Furthermore, it becomes difficult for external additives in the toner to adhere to the surface of the carrier, and the chargeability of the carrier itself can be kept stable, so that stabilization of the charging characteristics of the toner can be realized even when printing is performed over an extended period of time.

Moreover, it is preferable that the toner contains, as a lubricant, at least one or more metallic soaps of zinc stearate, calcium stearate, aluminum stearate, and magnesium stearate. With this configuration, the frictional force between toner particles or between the toner and the carrier can be reduced by an action of the metallic soap, so that the fluidity of the developer is improved. Thus, the ability to mix the developer in the buffer space near the magnet roller is improved, and uniformity of the density of the developer after drawing-up can be promoted even more.

Moreover, it is preferable that a toner replenishing port is provided above the magnet roller. With this configuration, the toner that newly has been replenished is supplied onto the magnet roller on which a magnetic brush is formed, so that this toner can be uniformly dispersed in the developer quickly because of a rotating action of the magnetic brush and a mixing action in the buffer space near the magnet roller. Thus, the toner density in the developing apparatus can be stabilized at a certain value or more within a short period of time after the toner has been replenished, and a stable image quality can be maintained over a long period of time.

Hereinafter, embodiments of the present invention will be described specifically with reference to the drawings.

Embodiment 1

Figure 2:
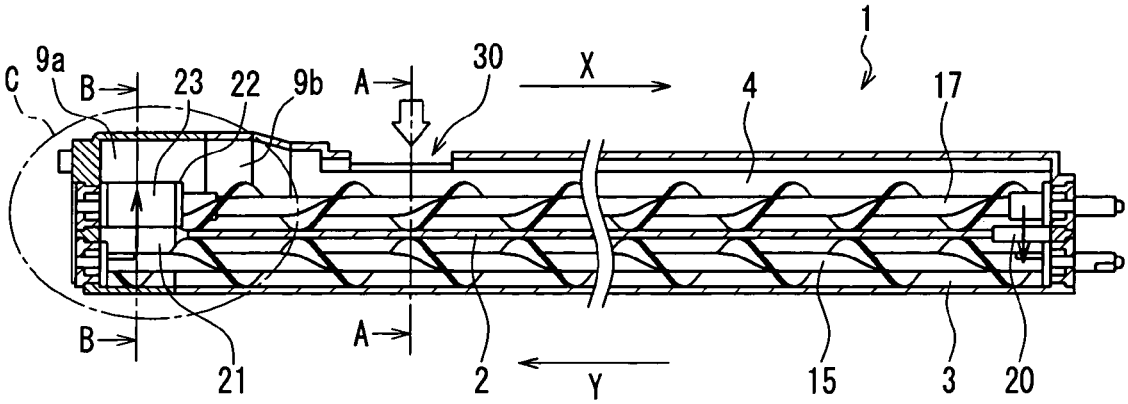
FIG. 2 is a cross-sectional view showing the relevant part of the developing apparatus in FIG. 1 seen from the direction of an arrow A.
Figure 3:
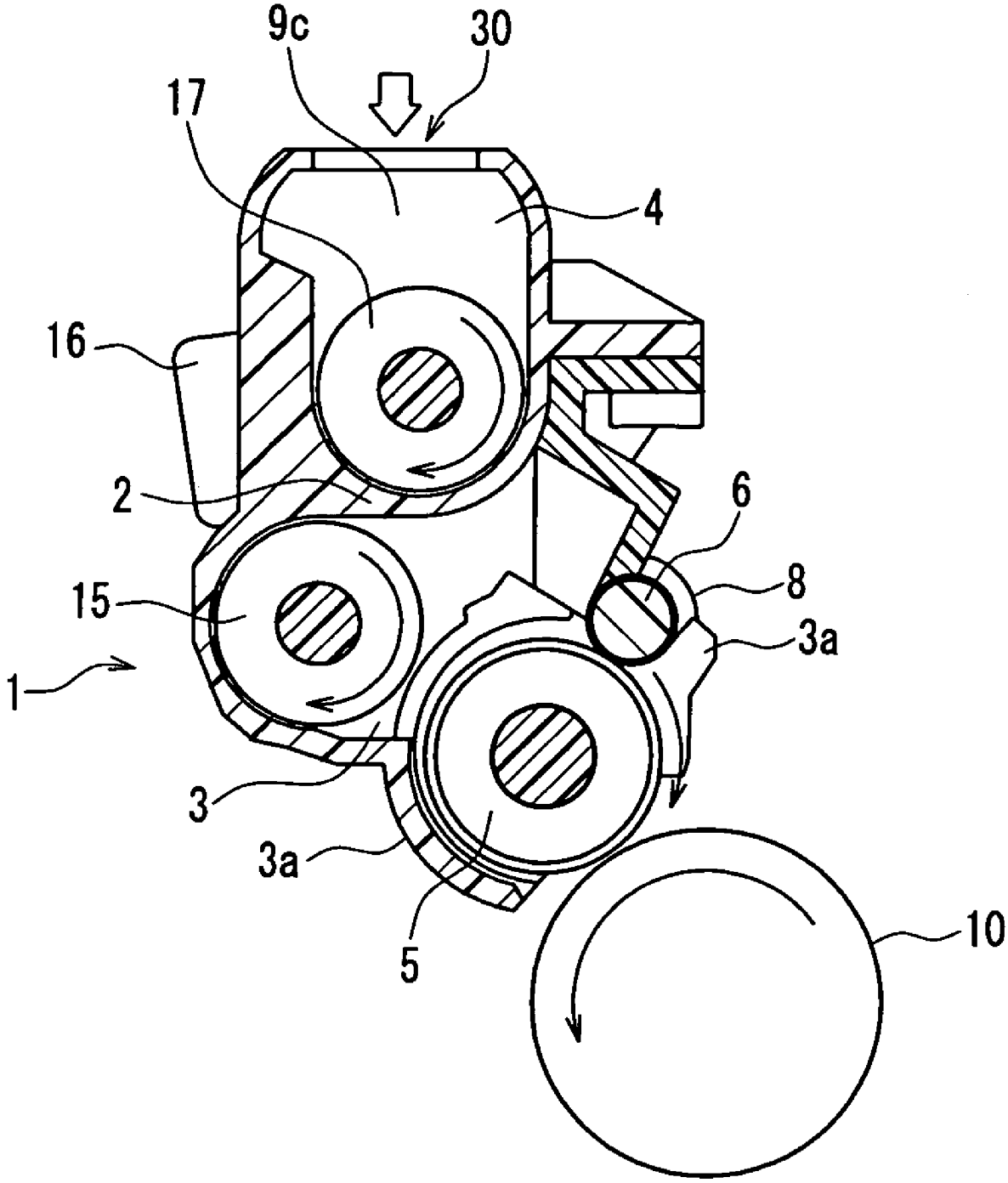
FIG. 3 is a diagram showing a cross-section taken along a line A-A in FIG. 2 in conjunction with a photosensitive drum.
Figure 4:
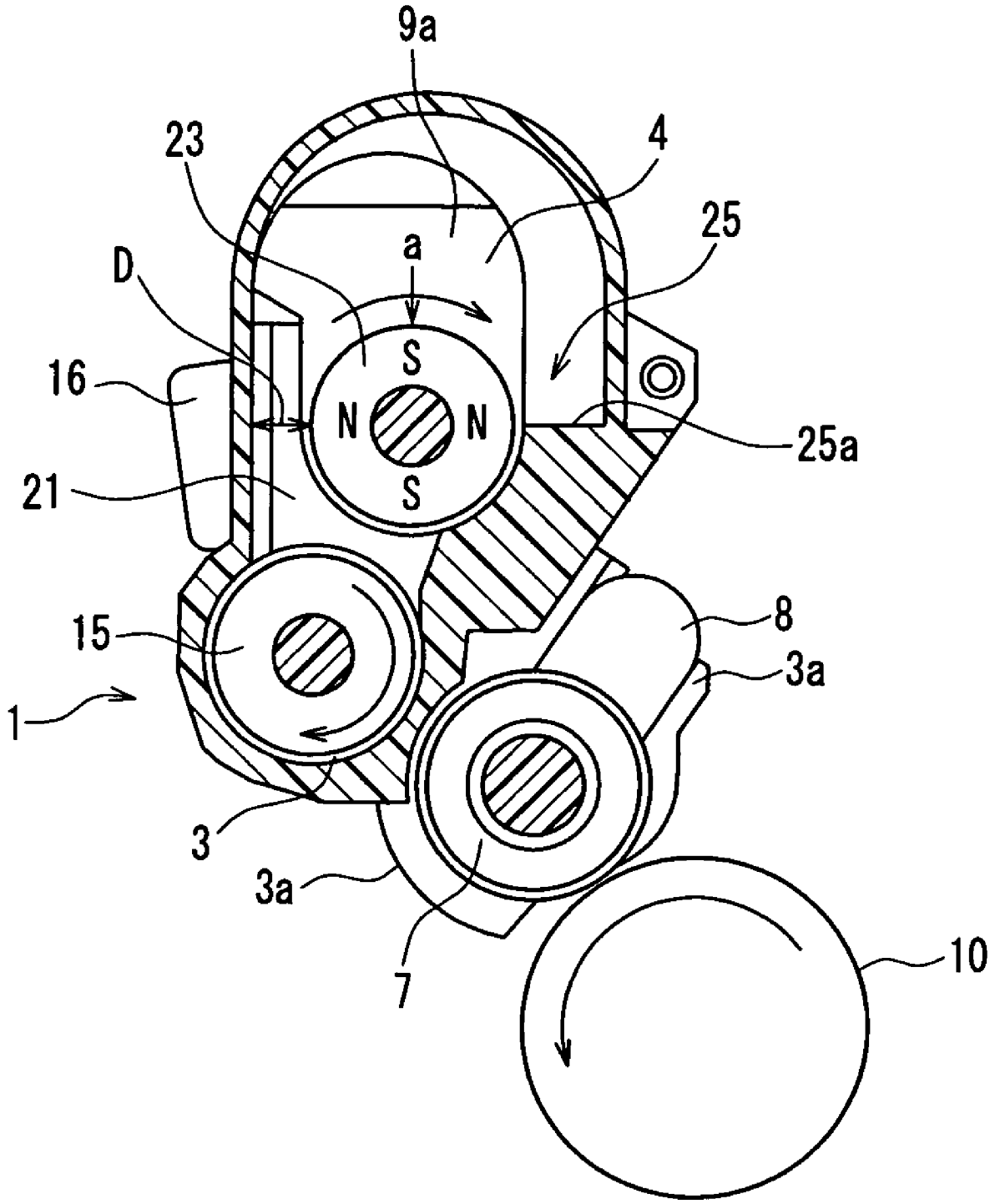
FIG. 4 is a diagram showing a cross-section taken along a line B-B in FIG. 2 in conjunction with the photosensitive drum.
Figure 5A:
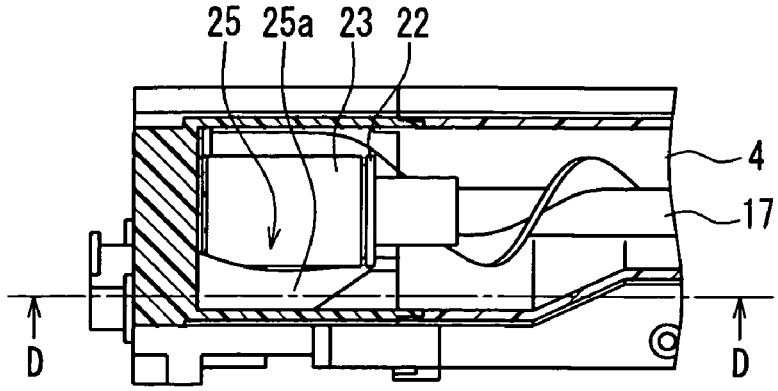
FIG. 5A is an enlarged view of a portion C in FIG. 2.
Figure 5B:
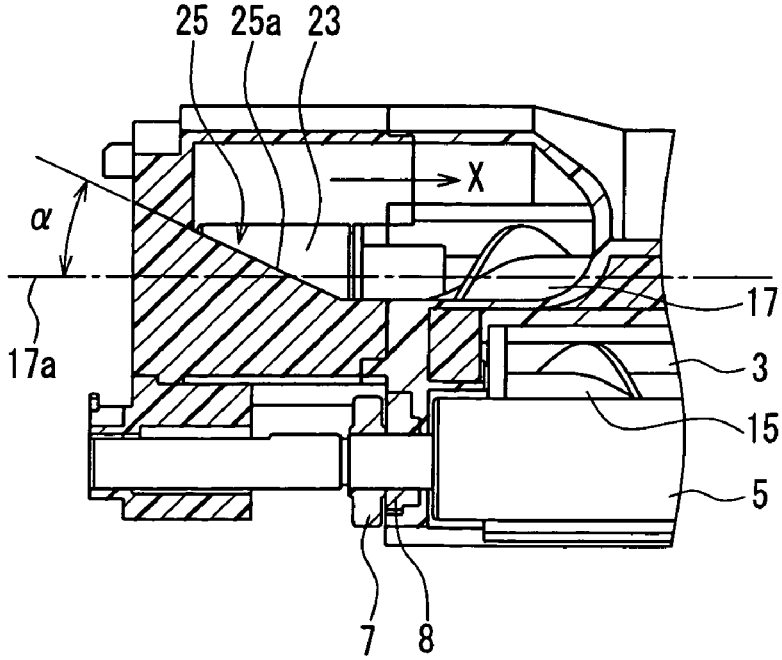
FIG. 5B is a cross-sectional view taken along a line D-D in FIG. 5A.

FIG. 1 is a perspective view schematically showing a configuration of a developing apparatus according to Embodiment 1 of the present invention, and FIG. 2, which shows the developing apparatus in FIG. 1 seen from the direction of an arrow A, is a cross-sectional view of the relevant part in the longitudinal direction. FIG. 3 is a cross-sectional view taken along a line A-A in FIG. 2, and FIG. 4 is a cross-sectional view taken along a line B-B in FIG. 2. FIGS. 3 and 4 also show a photosensitive drum 10, illustration of which is omitted in FIGS. 1 and 2. FIG. 5A is an enlarged view of a portion indicated by letter C in FIG. 2, and FIG. 5B is a cross-sectional view taken along a line D-D in FIG. 5A.

In FIG. 1, the developing apparatus includes a development housing 1 that is made of a resin material such as ABS. More specifically, especially as shown in FIGS. 2 and 3, the development housing 1 is divided by a partition wall 2 into an upper developer transport path 4 (first developer transport path) and a lower developer transport path 3 (second developer transport path).

In the lower developer transport path 3, there is formed a bulged portion 3*a* projecting from a portion in which a lower screw 15 is disposed toward the photosensitive drum 10 side as can be seen from FIGS. 3 and 4. As shown in FIGS. 1, 3, 4, and 5B, a bearing 8 is provided at each end of the bulged portion 3*a*, and a development roller 5 (developer holding member) and a doctor blade 6 each are held rotatably by the bulged portion 3*a* via these bearings 8.

The bearings 8 are formed of, for example, a resin material such as polyacetal. Moreover, there is a certain amount of gap between the surface of the development roller 5 and the doctor blade 6, and this gap is, for example, 0.4 mm.

Here, the development roller 5 has a configuration in which a non-magnetic development sleeve made of aluminum or the like contains a stationary magnet roller in which a predetermined number of magnet poles are disposed. When the development roller 5 is rotated, a magnetic brush of a developer, the length of which has been adjusted to a certain amount by the doctor blade 6, can be transported to a development region.

The doctor blade 6 regulates the amount of the developer to be transported on the development roller 5, with the gap between the doctor blade 6 and the development roller 5. As the doctor blade 6, it is possible to use, for example, a non-magnetic circular shaft (SUS 303, diameter: 5 mm) with which the gap, that is, the length of the bristles of the magnetic brush can be controlled relatively easily by adjusting the distance between the axis of the doctor blade 6 and that of the development roller 5.

Next, as shown in FIG. 3, the development roller 5 is disposed so that it faces the rotary photosensitive drum 10 (electrostatic latent image holding member). In this case, the gap between the development roller 5 and the photosensitive drum 10 is adjusted by changing the diameter of a gap roller 7 made of a resin and provided on both sides of the bearing 8, as shown in FIGS. 1, 4, and 5B.

The gap rollers 7 abut against the photosensitive drum 10, and, for example, when the diameter of the gap rollers 7 is increased, the photosensitive drum 10 is moved away from the development roller 5, so that the gap between the surface of the photosensitive drum 10 and that of the development roller 5 can be increased. This gap is set to, for example, 0.3 mm.

Moreover, although not shown in the drawings, a main charging apparatus and an optical system for performing image exposure are disposed on the upstream side of the rotational direction of the photosensitive drum 10, and a transfer mechanism using a transferring apparatus such as a scorotron or a transfer roller, a neutralization apparatus, and a cleaning apparatus such as a cleaning blade are disposed on the downstream side.

That is to say, the surface of the photosensitive drum 10 is charged uniformly by the main charging apparatus, and an electrostatic latent image is formed on the surface of the photosensitive drum 10 through image exposure by the optical system, and then, the magnetic brush of the developer that has been transported to the development region (between the development roller 5 and the photosensitive drum 10) by the development roller 5 as described above is rubbed against the electrostatic latent image. Consequently, a toner image is formed on the surface of the photosensitive drum 10. This toner image is transferred onto the surface of a transfer paper by the transfer mechanism. The transferred toner image is fixed to the surface of the transfer paper by a fixing mechanism that is provided on a path for discharging the transfer paper with a known method such as a method using heat or a method using pressure.

On the other hand, the surface of the photosensitive drum 10 after transfer of the toner image has been finished is neutralized by the neutralization apparatus to restore its electric potential to the level before the main charging, and furthermore, any toner remaining on the surface of the photosensitive drum 10 is removed by the cleaning apparatus, and thus, a single cycle of image formation is completed.

In particular, as shown in FIGS. 2 to 4, the lower screw 15 (second developer transporter) that extends in the axial direction of the development roller 5 is provided, at a distance from the development roller 5, in the lower developer transport path 3 of the development housing 1. In the upper developer transport path 4, there is provided an upper screw 17 (first developer transporter) that extends in the axial direction of the development roller 5. Moreover, a sensor 16, which has a detection portion located within the developer transport path 4, can detect the toner density in the developer based on, for example, the magnetic permeability of the developer.

In FIG. 2, the lower screw 15 and the upper screw 17 each can transport the developer in the axial direction of the development roller 5 while stirring the developer. In this case, the vane or the rotating direction of each of the screws 15 and 17 is set such that the transport directions of the screws 15 and 17 are opposite to each other. In the example shown in FIG. 2, a setting is made so that the upper screw 17 transports the developer in the direction of an arrow X (first developer transport direction) and the lower screw 15 transports the developer in the direction of an arrow Y (second developer transport direction).

As a specific example of the screws, the upper screw 17 and the lower screw 15 can be screws having a shaft diameter of 5 mm, a screw outer diameter of 12 mm, and a screw pitch of 25 mm and having different winding directions and lengths (upper screw 17: clockwise, 246 mm, lower screw 15: counter-clockwise, 265 mm). In this case, the screws 15 and 17 each can be coupled to driving means via a gear train, and, for example, the screws 15 and 17 can be rotated at the same rotating speed of 151 rpm.

As shown in FIG. 1, the bulged portion 3*a*, in which the development roller 5 is accommodated, in the lower developer transport path 3 is not formed over the full length of the development housing 1 in the longitudinal direction, and the bulged portion 3*a* (development roller 5) is not disposed in portions located at both ends of the upper and lower developer transport paths 4 and 3 in the longitudinal direction. The reason for this is that since the flow of the developer tends to be uneven at communicating holes 20 and 21 (FIG. 2) that will be described later, when the development roller 5 is adjacent to these holes, uneven supply of the developer to the development roller 5 is likely to occur.

As shown in FIG. 2, the communicating holes 20 and 21 for communicating the upper developer transport path 4 with the lower developer transport path 3 are formed at both ends of the development housing 1 in the longitudinal direction. The communicating hole 20 is disposed at a tip portion on the downstream side, in the developer transport direction (direction of the arrow X), of the upper screw 17. The communicating hole 20 is an opening (e.g., 6.5 mm width× 20 mm length) formed in the partition wall 2. The developer that has been stirred and transported to the communicating hole 20 by the upper screw 17 falls through the communicating hole 20 due to its weight and moves into the lower developer transport path 3.

On the other hand, the communicating hole 21 is disposed at a tip portion on the downstream side, in the developer transport direction (direction of the arrow Y), of the lower screw 15. The communicating hole 21 is an opening (e.g., 10 mm width×20 mm length) that is formed in the partition wall 2. A magnet roller 23 is provided above the communicating hole 21. The magnet roller 23 is coupled to an end portion 22 of the upper screw 17 such that the axis of the magnet roller 23 can be coaxial with the rotation axis of the upper screw 17. Moreover, the outer diameter of the magnet roller 23 is approximately equal to that of the upper screw 17 (having a diameter of 12 mm in the above-described example).

In this way, as shown in FIG. 4, the magnet roller 23 rotates with the rotation of the upper screw 17 in the same direction and draws up the developer in the lower developer transport path 3 into the upper developer transport path 4, in the form of a magnetic brush.

The magnet roller 23 can be, for example, a rubber magnet roller obtained by mixing barium ferrite powder in a rubber material such as nitrile rubber. Moreover, as shown in FIG. 4, the magnet roller 23 can be magnetized to have a total of four magnetic poles (N, S, N, S) having opposite polarities and the same magnetic force (65 mT), at intervals of approximately 90 degrees. The length of the magnet roller 23 in the axial direction is, for example, 18 mm. Moreover, it is preferable to attach a magnetic plate (not shown), such as SUS 430, having an outer diameter equal to that of the magnet roller 23 and a thickness of, for example, 0.5 mm to each end face of the magnet roller 23. This makes it possible to prevent the developer from adhering to the end faces of the magnet roller 23 and to prevent the resulting clogging and stagnation of the developer.

Moreover, as shown in FIG. 4, a scraper 25 (detaching and transporting means) is provided downstream of a vertically upward position of the magnet roller 23 in the rotating direction of the magnet roller 23, in a state in which the scraper 25 is close to the surface of the magnet roller 23. The gap between the outer circumferential surface of the magnet roller 23 and the scraper 25 is, for example, 0.2 mm.

The scraper 25, in the example shown in FIGS. 5A and 5B, is formed integrally with the development housing 1 and has an inclined surface 25*a*. The inclined surface 25*a* is inclined with respect to a horizontal plane that passes through a rotation axis 17*a* of the magnet roller 23 and traverses the development housing 1 in the width direction (direction of the arrow A in FIG. 1). Moreover, the inclined surface 25*a* is inclined such that the height thereof decreases along the direction of an arrow X.

It is preferable to set the angle $\alpha$ of inclination of the inclined surface 25*a* with respect to the above-described horizontal plane within a range of 10° or more and 30° or less. This is determined by giving consideration to, for example, the balance between the amount of the developer that stays temporarily in the neighborhood of the magnet roller 23 and the amount of the developer that is transported to the upper screw 17 by the scraper 25. That is to say, if the angle $\alpha$ of inclination is less than 10°, then the force for transporting the detached developer in the direction of the arrow X using the inclined surface 25*a* is decreased, and clogging and overflowing of the developer become more likely to occur in a portion for drawing up the developer.

On the contrary, if the angle $\alpha$ of inclination is more than 30°, then the force for transporting the detached developer in the direction of the arrow X using the inclined surface 25*a* is increased, but the time for stirring the developer in a buffer space is reduced, and the effect of mixing the developer also is weakened. Stirring of the developer in the buffer space win be described more specifically below.

It should be noted that this angle $\alpha$ of inclination can be determined experimentally depending on such conditions as the amount of the developer that is drawn up by the magnet roller 23, the length of the magnet roller 23, and developer conditions. The angle $\alpha$ of inclination, is for example, 25°.

Furthermore, as can be found from a comparison between the cross-sectional shape in FIG. 3 and the cross-sectional shape in FIG. 4, the cross-sectional shape (FIG. 4) of the development housing 1 surrounding the magnet roller 23 is like a dome, and this cross-sectional shape is different from the cross-sectional shape (FIG. 3) of the development housing 1 surrounding the upper screw 17.

In this case, the size (cross-sectional open area) of a space 9*a* of the developer transport path 4 that surrounds the magnet roller 23 shown in FIG. 4 is made larger than the size (cross-sectional open area) of a space 9*c* of the developer transport path 4 that surrounds the upper screw 17 shown in FIG. 3.

Moreover, as can be seen from FIG. 2, the cross section of the portion of the development housing 1 that includes a portion of the upper screw 17 that is near the magnet roller 23 has substantially the same shape as the cross section of the portion surrounding the magnet roller 23. In this way, the size (cross-sectional open area) of a space 9*b* of the developer transport path 4 that surrounds the upper screw 17 near the magnet roller 23 also is made larger than the size (cross-sectional open area) of the space 9*c* of the developer transport path 4 that surrounds the upper screw 17 shown in FIG. 3.

With this configuration, the space 9*a* (FIG. 4) surrounding the magnet roller 23 and the space 9*b* (FIG. 2) surrounding the upper screw 17 near the magnet roller 23 can be used as the buffer space in which the developer that has been drawn up from the lower developer transport path 3 can be allowed to stay temporarily.

It should be noted that when comparing the cross-sectional open areas, it is sufficient to compare the cross-sectional open areas of the portions above the rotation axis 17*a*.

Moreover, in order to draw up the developer smoothly by the magnet roller 23, as shown in FIG. 4, a clearance (clearance D) between a wall surface leading from the lower developer transport path 3 to the upper developer transport path 4 and the outer circumferential surface of the magnet roller 23 is made larger than a clearance between the outer circumferential surface of the upper screw 17 shown in FIG. 3 and a wall surface around it. This clearance D can be experimentally determined depending on such conditions as the amount of the developer that is transported per unit time by the lower screw 15, the capacity of the magnet roller 23 to draw up the developer, and developer conditions. The clearance D is, for example, 3.5 mm.

Moreover, as shown in FIGS. 1 and 2, a toner replenishing port 30 is provided downstream of this drawing-up portion. When the toner is consumed through repeated development and the toner density in the developing apparatus is reduced to a predetermined value or less, this is detected by the sensor 16. In this case, a predetermined amount of toner is added into the upper developer transport path 4 from a toner cartridge (not shown) via the toner replenishing port 30, so that a certain toner density can be secured.

According to this embodiment, by the rotation of the magnet roller 23, the developer that has been transported through the lower developer transport path 3 passes, in the form of a magnetic brush, through the clearance D and is smoothly drawn up into the upper developer transport path 4. Then, this developer is detached from the surface of the magnet roller 23 using the inclined surface 25*a* of the scraper 25.

Here, as described above, the space 9*a* (FIGS. 2 and 4) surrounding the magnet roller 23 and the space 9*b* (FIG. 2) surrounding the screw 17 near the magnet roller 23 form the buffer space that is larger in dimensions than the space 9*c* (FIG. 3) surrounding the screw 17 downstream.

Thus, the developer that has been detached stays temporarily on the inclined surface 25*a*. With the rotation of the magnet roller 23, the detached developer is supplied continuously to this buffer space. Accordingly, the developer that previously has been detached and the developer that subsequently has been detached are transported to downstream of the developer transport path 4, due to the inclination of the inclined surface 25*a*, while they are sufficiently mixed.

Therefore, the developer, the density of which became uneven because the toner has been consumed through development, quickly is rendered uniform by the mixing effect in this drawing-up portion. Moreover, since the clearance D and the space having a sufficient size in the neighborhood of the magnet roller 23 are secured, accumulation and clogging of the developer in the end portion below the magnet roller 23 of the developer transport path 3, or uneven image density, deterioration of the developer, breaking of the screw, and the like that may be caused by such accumulation and clogging also can be prevented effectively.

Moreover, since the toner that newly has been replenished from the toner replenishing port 30 that is provided downstream of the drawing-up portion is mixed with the developer, the density of which has been rendered uniform in the buffer space near the magnet roller 23, the toner density in the apparatus can be stabilized at a certain value or more within a relatively short period of time after the toner is replenished, and thus a stable image quality can be maintained over a long period of time.

Hereinafter, various materials, methods for measuring these materials, and so on will be described using specific examples. The toner that is used in this embodiment is a magenta toner. First, 86 wt % of a polyester resin, 5 wt % of an azo pigment that is a magenta coloring agent, 6 wt % of carnauba wax serving as a parting agent, and 3 wt % of a charge control agent made of zinc salicylate were premixed. This mixture was melt-kneaded, roughly pulverized, and then finely pulverized, and the resulting fine particles were graded to obtain non-magnetic toner matrix particles having an average particle size of 7.1 μm. After this, 1.0 wt % of hydrophobic silica and 0.5 wt % of hydrophobic titania were added (mixed) as external additives to 98.5 wt % of the toner matrix particles.

Moreover, the carrier is a resin carrier containing a magnetic material (hereinafter, referred to as "resin carrier"). First, 88 wt % of magnetite having an average particle size of 0.2 μm were dispersed in 12 wt % of a thermosetting phenolic resin that is the main component so that the average particle size was 35 μm. Furthermore, the surface of the carrier was coated with a dimethyl silicone resin so that the volume resistivity was $1\times10^{13}$ Ω·cm. At this time, the specific gravity was 3.7 g/cm$^3$, and the saturation magnetization was 60.2 Am$^2$/kg.

In a developing apparatus according to an embodiment described later, 120 g of a developer constituted by the above-described toner and resin carrier and having a toner density of 10.5% was filled.

Moreover, the properties of the above-described toner and resin carrier were measured using the following method. First, the particle size distribution of the toner was measured using a Coulter Counter (manufactured by Coulter Counter).

Next, the strength of magnetization of the carrier was measured using a vibrating sample magnetometer (model VSM-P7-15: manufactured by Toei Industry Co., Ltd.). The measurement magnetic field was 79.58 kA/m (1 kOe). The measurement was carried out in an environment at a temperature of 23° C. and a humidity of 50%.

Moreover, the carrier resistance was measured using an ultra insulation resistance tester (SM-8210: manufactured by DKK-TOA CORPORATION). The distance between electrodes was 0.4 mm, and a magnet having a cross-sectional area of 30 mm width×13 mm was attached to an outer portion of each of the electrodes such that the magnets were opposed to each other. The magnetic force inside the electrodes was measured with a gauss meter (HGM8900: manufactured by TOYO JIKI INDUSTRY CO., LTD.), and the magnetic force was 60 mT. After 0.2 g of the carrier were placed between the electrodes, a voltage of 50 V was applied, and the value of resistance was measured 30 seconds later. The volume resistivity was calculated from the electrode area and the distance between the electrodes. The measurement was carried out in an environment at a temperature of 23° C. and a humidity of 50%.

Moreover, the specific gravity of the carrier was measured using an air comparison pychnometer manufactured by Beckman. The measurement was performed using a sample amount of 30 g.

Moreover, the particle size distribution of the carrier was measured with a particle size distribution measuring apparatus (LA-920: manufactured by HORIBA, Ltd.) using the principles of laser diffraction/scattering. The particle size of the carrier was measured in a dispersion to which a surfactant, sodium laurylsulfate, was added.

In this embodiment, the non-magnetic circular shaft was used as the doctor blade 6. However, it is also possible to use, for example, a non-magnetic flat blade, a magnetic circular shaft or flat blade, or non-magnetic or magnetic flat blades that are attached one above the other, depending on such conditions as developer conditions, specified service life, and arrangement of the magnetic poles in the development roller 5.

Moreover, although the example in which the rotation axis of the lower screw 15 is disposed above the rotation axis of the development roller 5 has been described, the present invention is not limited to this example. That is to say, it is sufficient that a configuration in which the developer is drawn up from the lower screw 15 to the upper screw 17 can be achieved. Thus, the rotation axis of the lower screw 15 may be disposed on a level with or below the rotation axis of the development roller 5.

Moreover, although the rubber magnet roller that is obtained by mixing barium ferrite powder in a rubber material such as nitrile rubber was used as the magnet roller 23, it is also possible to use a plastic magnet roller in which a synthetic resin such as nylon is combined instead of the rubber material such as nitrile rubber. Furthermore, it is also possible to use a magnet roller having a non-magnetic sleeve made of aluminum or the like that contains a plurality of magnetic poles such as plastic magnets.

When using the magnet roller having a sleeve in which a plurality of magnetic poles is disposed, either of a configuration in which the sleeve is fixed and the internal magnetic poles are rotated, a configuration in which the sleeve is rotated and the internal magnetic poles are fixed, and a configuration in which both of the sleeve and the internal magnetic poles are rotated can be used.

Moreover, the magnetic roller magnetized so as to have four poles (at intervals of approximately 90 degrees) and having a magnetic force of 65 mT was used as the magnet roller 23. However, if the developer that has been transported by the lower screw 15 can be drawn up stably, a magnetic roller having a different number of magnetic poles, a different magnetic force, or a different arrangement of the magnetic poles may be used.

Moreover, although the magnetic roller 23 was fixedly coupled to the end portion of the upper screw 17 and rotated with the screw 17, the magnet roller 23 may be rotated independently of the screw 17. In this case, means for driving the magnet roller 23, other than the screw 17, is required. However, the amount of the developer that is drawn up can be adjusted by adjusting the rotating speed of the magnet roller 23. For example, by increasing the rotating speed of the magnet roller 23, the effect of mixing the developer can be increased even more.

Moreover, although the scraper 25 was formed integrally with the development housing 1, it is also possible to use a configuration in which the scraper 25 is formed as a separate member and mounted on the development housing 1.

Moreover, although the scraper 25 was constructed from the same resin material as the development housing 1, the scraper may be constructed from a rubber member made of urethane rubber or the like, or a metal material made of aluminum, stainless steel, or the like.

Moreover, although the scraper 25 was disposed close to the magnet roller 23, the scraper 25 may be disposed in contact with the magnet roller 23. In this case, the developer that is held on the surface of the magnet roller 23 can be detached more reliably, and the efficiency of drawing up the developer can be increased. However, with this configuration, the driving torque of the magnet roller 23 increases. In addition, the scraper 25 and the surface of the magnet roller 23 become susceptible to deterioration. In order to prevent this, it is desirable to use a magnet roller in which a metal sleeve has a plurality of magnetic poles disposed therein and the magnetic poles are rotated and the sleeve is fixed, as the magnet roller 23.

Moreover, the clearance D shown in FIG. 4 is secured by keeping the wall surface leading from the lower developer transport path 3 to the upper developer transport path 4 away from the outer circumferential surface of the magnet roller 23. The present invention is not limited to this, and the clearance D can be secured by reducing the outer diameter of the magnet roller 23 or by combining both of these methods. In this case, the buffer space for the developer in the neighborhood of the magnet roller 23 also can be enlarged at the same time. However, when reducing the diameter of the magnet roller 23, it is desirable to adjust the length of the magnet roller 23 and the magnetic force for magnetization, giving consideration to such facts that the distance between the magnet roller 23 and the lower screw 15 is increased, that the surface area of the magnet roller 23 is decreased.

Moreover, although the polyester resin was used as a binder resin, it is also possible to use a styrene acrylic resin, an epoxy resin, and the like.

Moreover, examples of the pigment that can be used in this embodiment include pigments containing one or more types of the following pigments and dyes: black pigments such as carbon black, iron black, graphite, nigrosine, and a metal complex of an azo dye; arylamide acetoacetate monoazo yellow pigments such as C.I. pigment yellow 1, 3, 74, 97, and 98; arylamide acetoacetate diazo yellow pigments such as C.I. pigment yellow 12, 13, 14, and 17; C.I. solvent yellow 19, 77, and 79; C.I. disperse yellow 164; red pigments such as C.I. pigment red 48, 49:1, 53:1, 57, 57:1, 81, 122, and 5; red dyes such as C.I. solvent red 49, 52, 58, and 8; and blue dyes or pigments such as phthalocyanine or a derivative thereof, such as C.I. pigment blue 15:3. The amount of the pigment to be added is preferably from 3 to 8 parts by weight per 100 parts by weight binder resin.

Moreover, in order to charge the toner, one or more types of charge control agents may be added, if necessary. In this case, about 1 to 7 wt % of material can be added according to whether the toner is to be charged negatively or positively.

Moreover, in order to improve charging of the toner or the fluidity of the toner, microparticles having an average particle size of 5 to 200 nm, such as silica, alumina, and titania, are added. The surface of the microparticles can be subjected to a surface treatment with a silane coupling agent, silicone oil, and the like, if necessary, in order to impart hydrophobicity or to control charging.

Moreover, it is desirable that the average particle size of the toner is 3 to 12 μm. If the particle size is large, it is difficult to achieve a high resolution. If the particle size is too small, the fluidity of the toner is poor, so that the mixing property with the carrier deteriorates.

Moreover, as the carrier, a mixed type carrier made of a resin and a magnetic material or a carrier made of a magnetic material alone can be used. Examples of the resin used in the mixed type carrier include phenolic resins, urea resins, melamine resins, polyester resins, and epoxy resins. In particular, thermosetting resins, which are represented by phenolic resins, have better durability, impact resistance, and heat resistance than thermoplastic resins, so that a resin carrier that is made of a magnetic material and a thermosetting resin to utilize these advantages is desirable.

Moreover, as a ferromagnetic iron compound particle powder, ferromagnetic iron oxide particle powders such as magnetite and maghemite, spinel ferrite particle powders containing one or more types of metal (e.g., Mn, Ni, Zn, Mg, and Cu) other than iron, magnetoplumbite type ferrite particle powders such as barium ferrite, and microparticle powders of iron and iron alloys having an oxide film formed on the surface thereof can be used. Ferromagnetic iron oxide particle powders such as magnetite are preferable. The particle size of the ferromagnetic iron compound particles preferably is 0.02 to 5 μm. The shape may be any of granular, spherical, or acicular.

The amount of the magnetic material added in the resin preferably is 50 wt % or more, and in a resin carrier, it is particularly preferable that the amount is 70 wt % to 90 wt %. When the amount is less than 50 wt %, the magnetic force of the carrier is reduced, leading to a problem in that the carrier becomes likely to adhere to the photosensitive drum (electrostatic latent image holding member).

Moreover, examples of the resin for forming a coating layer on the surface of the carrier include one or more types of resins. More specifically, one or more types of resins selected from phenolic resins, epoxy resins, melamine resins, polyamide resins, polyester resins, styrene resins, silicone resins, fluororesins, and the like are preferable.

Moreover, formation of the coating layer, using the resin, on the surface of the carrier can be performed by, for example, a method in which the resin is sprayed onto dispersed particles of a magnetic material using a spray dryer or the like, a method in which the dispersed particles of a magnetic material and the resin are dry mixed using a Henschel mixer, a high speed mixer, or the like, or a method in which spherical composite core particles are impregnated in a solvent containing the resin.

Moreover, although the mixed type resin carrier made of a resin and a magnetic material was used as the carrier, the present invention is not limited to this. For example, a carrier made of a magnetic material alone, in which Mn—Zn ferrite having an average particle size of 35 μm is used as the core material and furthermore, the surface of which is coated with a silicone resin, may be used.

Embodiment 2

Figure 6A:
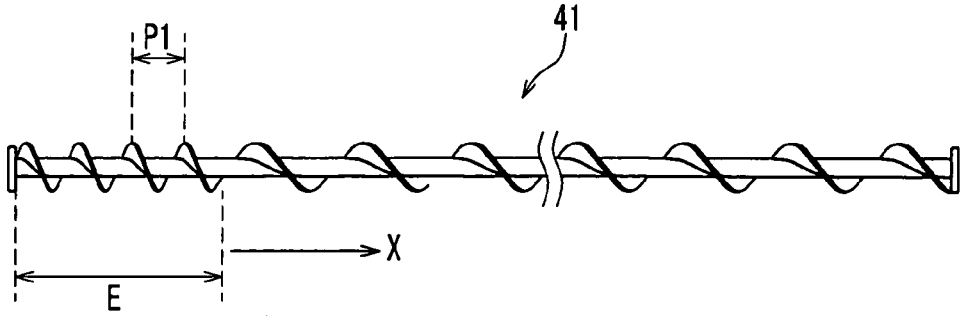
FIG. 6A is a diagram showing a shape of a screw vane of an upper screw in a developing apparatus according to Embodiment 2 of the present invention.
Figure 6B:
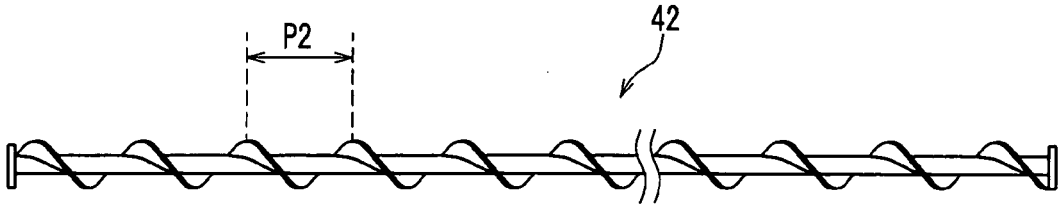
FIG. 6B is a diagram showing a shape of a screw vane of a lower screw in the developing apparatus according to Embodiment 2 of the present invention.

FIG. 6A shows an upper screw in a developing apparatus according to Embodiment 2, and FIG. 6B shows a lower screw. Embodiment 2 is the same as Embodiment 1 except for the configuration relating to the upper and lower screws.

In the upper screw 41 shown in FIG. 6A, the screw pitch P1 in a portion E near the magnet roller 23 is smaller than the screw pitch in other portions. The lower screw 42 shown in FIG. 6B has a screw pitch P2 over the entire screw. The value of this screw pitch P2 is larger than that of the screw pitch P1. The gear train of the developing apparatus is configured such that the lower screw 42 and the upper screw 41 can be rotated at the same rotating speed.

With this configuration, since the screw pitch P1 of the upper screw 41 near the magnet roller 23 is smaller than the screw pitch P2 of the lower screw 42, the lower screw 42 is superior to the upper screw 41 with respect to the speed to transport the developer at the front and rear of the magnet roller 23.

That is to say, the transporting speed of the developer that is transported by the lower screw 42 is greater than the transporting speed of the developer that is transported by the upper screw 41 near the magnet roller 23. This makes the developer that has been drawn up remain and be mixed for a longer period of time in the buffer space near the magnet roller 23, which is more advantageous in rendering the density of the drawn-up developer uniform.

It should be noted that although the example in which the upper and lower screws were provided with different screw pitches as a method for making a difference between the transporting speed of the screws has been shown, the present invention is not limited to this example. For example, even when the upper and lower screw pitch are same, if the rotating speed of the lower screw 42 is made faster than that of the upper screw 41, the same effect as described above can be achieved.

Furthermore, in this case, the period of time for mixing developer can be secured sufficiently, so that charge is given to newly replenished toner sufficiently. As a result, toner dispersion and fog of a white paper portion due to shortage of the charge amount of the toner can be prevented effectively.

Embodiment 3

Embodiment 3 is characterized by the toner, and in other aspects, Embodiment 3 is the same as Embodiment 1. In a developing apparatus according to Embodiment 3, a toner having a shape factor, SF value, of 140 or less is used. The shape factor, SF value, represents the sphericity of the toner. It was calculated, using an image analyzer, with Formula 1 below based on the projected area (A) and the maximum length (ML) of each toner particle determined with an optical microscope. Actually, after 500 particles were measured, an average value was obtained.

$$SF\ \text{value}=(ML^2/A)\times(\sigma/4)\times 100 \qquad \text{Formula (1)}$$

In order to confirm the effect of Embodiment 3, an experiment was conducted as follows. First, toner matrices that underwent a pulverizing step and a grading step and that had a shape factor, SF value, of 160 were subjected to a spherical treatment with a suffusing apparatus (manufactured by NIPPON NEUMATIC MFG. CO., LTD) utilizing heat, under seven different conditions, i.e., treated at 350° C., 320° C., 290° C., 260° C., 230° C., or 200° C., or not treated at all. At this time, the shape factors, SF values, of the toner matrices were 101, 107, 121, 132, 140, 149, and 160, respectively. The external additives described in Embodiment 1 were added to the toner matrices, and then the toner matrices were mixed with the resin carriers described in Embodiment 1 to prepare seven different types of developers in an amount of 120 g each, having a toner density of 10.5%.

Each of the developers was filled into the developing apparatus described in Embodiment 1, and then, the developing apparatus was mounted to a commercially available laser printer (KX-CL500: manufactured by Panasonic) that was modified. This printer exhibits a processing speed of 100 mm/s and is capable of color printing about 16 sheets of A4 paper per minute.

The development roller 5 of the developing apparatus rotates in the same direction as the photosensitive drum 10 at a peripheral velocity ratio of 1.13 with respect to the photosensitive drum 10, and transports about 40 mg/cm$^2$ of developer to the development region that is a position opposed to the photosensitive drum 10. At this time, a developing bias voltage in which an alternating voltage constituted by a rectangular wave having a frequency of 6 kHz and a peak-to-peak value Vpp of 1.3 kV was superimposed with a dc voltage of −500 V was applied to the development roller 5 from a developing bias supply (not shown).

Moreover, a charging bias voltage in which an alternating voltage constituted by a rectangular wave having a frequency of 2 kHz and a peak-to-peak value Vpp of 2 kV was superimposed with a dc voltage of −635 V was applied to the main charging apparatus (not shown) disposed upstream in the direction of rotation of the photosensitive drum 10, thereby charging uniformly the surface of the photosensitive drum. At this time, the surface potential of the photosensitive drum 10 was measured with a surface potential measuring instrument (MODEL 344: manufactured by Treck), and the surface potential was −650 V.

Moreover, as the optical system that also is disposed upstream in the direction of rotation of the photosensitive drum 10, as with the case of the main charging apparatus, a laser scanning unit (not shown) having a resolution of 600 Dpi (dot/inch) was used to form an electrostatic latent image of a desired image. With this laser scanning unit, a solid image was exposed, and the surface potential in that exposure area was measured and found to be −100 V.

A toner image that had been formed on the photosensitive drum 10 through the above-described charging, exposing, and developing steps was transferred onto an intermediate transfer belt (not shown) made from a polycarbonate film, by applying a voltage of +600 V to a primary transfer roller (not shown) located on the back of the belt.

Then, a color toner image formed by superimposing the toner images of various colors, yellow, magenta, cyan, and black, on the intermediate transfer belt was transferred onto paper transported to a secondary transfer position, by applying a voltage of +1000 V to a secondary transfer roller (not shown) located on the back of the paper.

Finally, the paper was passed through a fuser (not shown) for fixation, and thus a color image was formed. In the meantime, the surface of the photosensitive drum 10, after the transfer of the toner images was completed, is neutralized by the neutralization apparatus to restore the electric potential thereof to the level before the main charging. Furthermore, by the cleaning apparatus using, for example, a cleaning blade made of urethane rubber, any toner remaining on the surface of the photosensitive drum is removed.

In this experiment, in order to evaluate the variance in the density of the developer immediately after the developer was drawn up, a solid image having 100% image coverage was output to a single sheet of A4 size paper by transporting the paper in the longitudinal direction without replenishing the toner, using the above-described image formation process. After this, about 0.2 g each of samples of the developer in the upper transport path 4 were collected at ten points spaced away from a junction 22 between the magnet roller 23 and the upper screw 17 in increments of 5 mm, and the toner density was measured for each of the samples. The toner density was calculated by measuring the mass of the developer before and after suction of the toner using a blow-off powder charge measuring instrument (manufactured by Toshiba Chemical Corporation).

Figure 7:
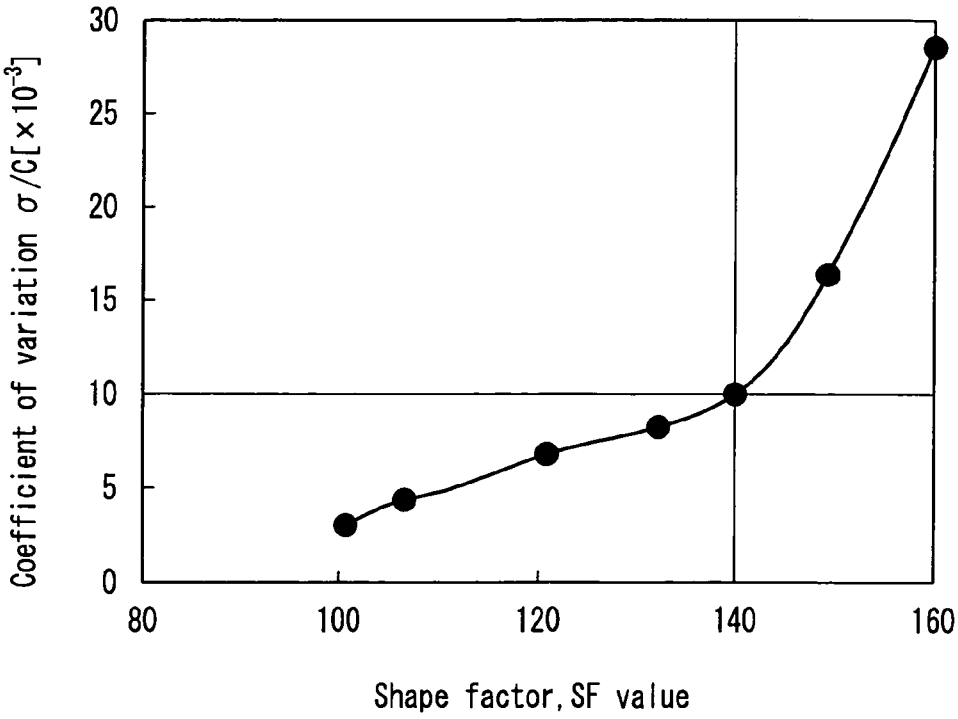
FIG. 7 is a diagram showing a relationship between the shape factor, SF value, and the coefficient of variation $\sigma/C$ in the developing apparatus according to Embodiment 2 of the present invention.

This measurement was performed using the above-described toners having the different shape factors, SF values, and the toner density average value C, the standard deviation σ, and the coefficient of variation σ/C were calculated for each of the toners. The more sufficiently the developer after development is mixed in the drawing-up portion, the smaller this coefficient of variation σ/C becomes. FIG. 7 shows the relationship between the shape factor, SF value, and the coefficient of the evariation σ/C, and Table 1 below shows evaluation results with respect to the variance in the density of the developer immediately after the developer has been drawn up and evaluation results with respect to overflowing, clogging, and accumulation of the developer in the end portion of the lower transport path.

Regarding the variance in the density of the developer, "very good" indicates that the coefficient of variation σ/C [$\times 10^{-3}$] is 10 or less, "good" indicates that it is 10 to 35, "fair" indicates that it is 35 to 50, and "poor" indicates that it is 50 or more. Regarding overflowing, clogging, and accumulation of the developer in the lower developer transport path, "good" indicates that none of these phenomena occurs, "fair" indicates that only accumulation of the developer occurs, and "poor" indicates that all of these phenomena occurs.

In Working Examples 1 to 7 shown in Table 1, the above-described seven different types of toner matrices having the different shape factors, SF values, were used. More specifically, the shape factor, SF value, was 160 in Working Example 1, 149 in Working Example 2, 140 in Working Example 3, 132 in Working Example 4, 121 in Working Example 5, 107 in Working Example 6, and 101 in Working Example 7.

Moreover, Comparative Example 1 shown in Table 1, is an example using a developing apparatus in which the buffer space is not provided, and the toner described in Embodiment 1 that has a shape factor of 121.

TABLE 1

| | Evaluation of variance in developer density | Evaluation of clogging, overflowing, and accumulation of developer |
|---|---|---|
| Working Ex. 1 | good | good |
| Working Ex. 2 | good | good |
| Working Ex. 3 | very good | good |
| Working Ex. 4 | very good | good |
| Working Ex. 5 | very good | good |
| Working Ex. 6 | very good | good |
| Working Ex. 7 | very good | poor |
| Com. Ex. 1 | poor | fair |

As is apparent from the results in FIG. 7, when the shape factor, SF value, was 140 or less, the evaluation result of variance in the density of the developer was "very good", which means that a good result could be obtained. On the other hand, when the developing apparatus in which the buffer space is not provided was used, variance in the density of the developer could not be reduced even when the toner having a shape factor, SF value, of 121 was used, as shown in Comparative Example 1.

However, as can be found from the results in the working examples, it can be said that when the SF value is set to 140 or less, the effect of promoting uniformity of the density of the developer after drawing-up can be exhibited reliably. That is to say, when a toner with high sphericity is used, an effect of reducing the frictional force between toner particles or between the toner and the carrier is exhibited. Thus, it seems that the good results for the working examples could be obtained because the fluidity of the developer was improved by the use of the toners with high sphericity and thus the ability to mix the developer in the buffer space near the magnet roller was improved.

Furthermore, when a toner with high sphericity is used, a reduction in the chargeability of the carrier also can be prevented effectively because the shape of the toner tends not to change even under stress and a wax component serving as the parting agent tends not to migrate to the carrier.

In this embodiment, although thermal treatment was used as a method for increasing the sphericity of the toner, a suspension polymerization method, an emulsion polymerization method, and the like also may be used as a method for preparing a toner matrix.

Embodiment 4

In Embodiment 4, a carrier prepared by coating the surface of the resin carrier of Embodiment 1 with a fluorine-modified silicone resin was used. In other respects, Embodiment 4 is the same as Embodiment 1. It should be noted that evaluation results with respect to variance in the density of the developer immediately after drawing-up and evaluation results with respect to overflowing, clogging, and accumulation of the developer in the end portion of the lower transport path, which were obtained in the same experiment as in Embodiment 3, are shown in Table 2.

Moreover, Comparative Example 2 shown in Table 2 is an example using a developing apparatus of the Comparative Example 1 as described above, and a carrier prepared by coating the surface of the resin carrier of Embodiment 1 with a fluorine-modified silicone resin was used.

TABLE 2

| | Evaluation of variance in developer density | Evaluation of clogging, overflowing, and accumulation of developer |
|---|---|---|
| Embodiment 1 | good | good |
| Embodiment 4 | very good | good |
| Com. Ex. 2 | poor | fair |

From these results, it was found that by using the fluorine-modified silicone resin as a coating agent for the carrier, the effect of mixing the developer in the drawing-up portion in Embodiment 1 can be increased even more. On the other hand, when the developing apparatus in which the buffer space is not provided was used, variance in the density of the developer could not be reduced even when the dispersed-type magnetic carrier having the surface coated with the fluorine-modified silicone was used, as shown in Comparative Example 2.

However, as can be found from the results in the working examples, it can be said that when a coating agent is used for the carrier, the effect of promoting uniformity of the density of the developer after drawing-up can be exhibited reliably. That is to say, with a carrier having high lubricity, the adhesion of the carrier to the magnet roller and the frictional force between carrier particles are reduced. Thus, it seems that the good results for the working examples could be obtained because detachment of the developer from the magnet roller was stabilized and thus the ability to mix the developer in the buffer space near the magnet roller was improved.

Furthermore, according to this embodiment, it becomes difficult for the external additives of the toner to adhere to the surface of the carrier and the chargeability of the carrier itself can be kept stable, so that stabilization of the chargeability of the toner can be realized even when printing is performed over an extended period of time.

Embodiment 5

In Embodiment 5, 1.5 wt % of zinc stearate was added as an external additive to the toner of Embodiment 1. In other respects, Embodiment 5 is the same as Embodiment 1. Evaluation results with respect to variance in the density of the developer immediately after drawing-up and evaluation results with respect to overflowing, clogging, and accumulation of the developer in the end portion of the lower transport path, which were obtained in the same experiment as in Embodiment 3, are shown in Table 3.

Moreover, Comparative Example 3 shown in Table 3 is an example using a developing apparatus of the Comparative Example 1 as described above, and a carrier prepared by adding 1.5 wt % of zinc stearate as an external additive to the toner of Embodiment 1.

TABLE 3

| | Evaluation of variance in developer density | Evaluation of clogging, overflowing, and accumulation of developer |
|---|---|---|
| Embodiment 1 | good | good |
| Embodiment 5 | very good | good |
| Com. Ex. 3 | poor | fair |

From these results, it was found that by using zinc stearate as the external additive for the toner, the effect of mixing the developer in the drawing-up portion in Embodiment 1 can be increased even more. On the other hand, when the developing apparatus in which the buffer space is not provided was used, variance in the density of the developer could not be reduced even when the toner to which 1.5 wt % of zinc stearate was added as the external additive was used, as shown in Comparative Example 3.

However, as can be found from the results in the working examples, it can be said that when zinc stearate is used as the external additive for the toner, the effect of promoting uniformity of the density of the developer after drawing-up can be exhibited reliably. That is to say, the frictional force between toner particles or between the toner and the carrier is reduced by the action of a metallic soap. Thus, it seems that the good results for the working examples could be obtained because the fluidity of the developer was improved and thus the ability to mix the developer in the buffer space near the magnet roller was improved.

It should be noted that although the example in which zinc stearate was used as the external additive was described, it seems that the same effect can be exhibited with any compound, as long as the compound has the action of a metallic soap. Thus, the toner may contain, as a lubricant, at least one or more metallic soaps of zinc stearate, calcium stearate, aluminum stearate, and magnesium stearate.

Embodiment 6

Figure 8:
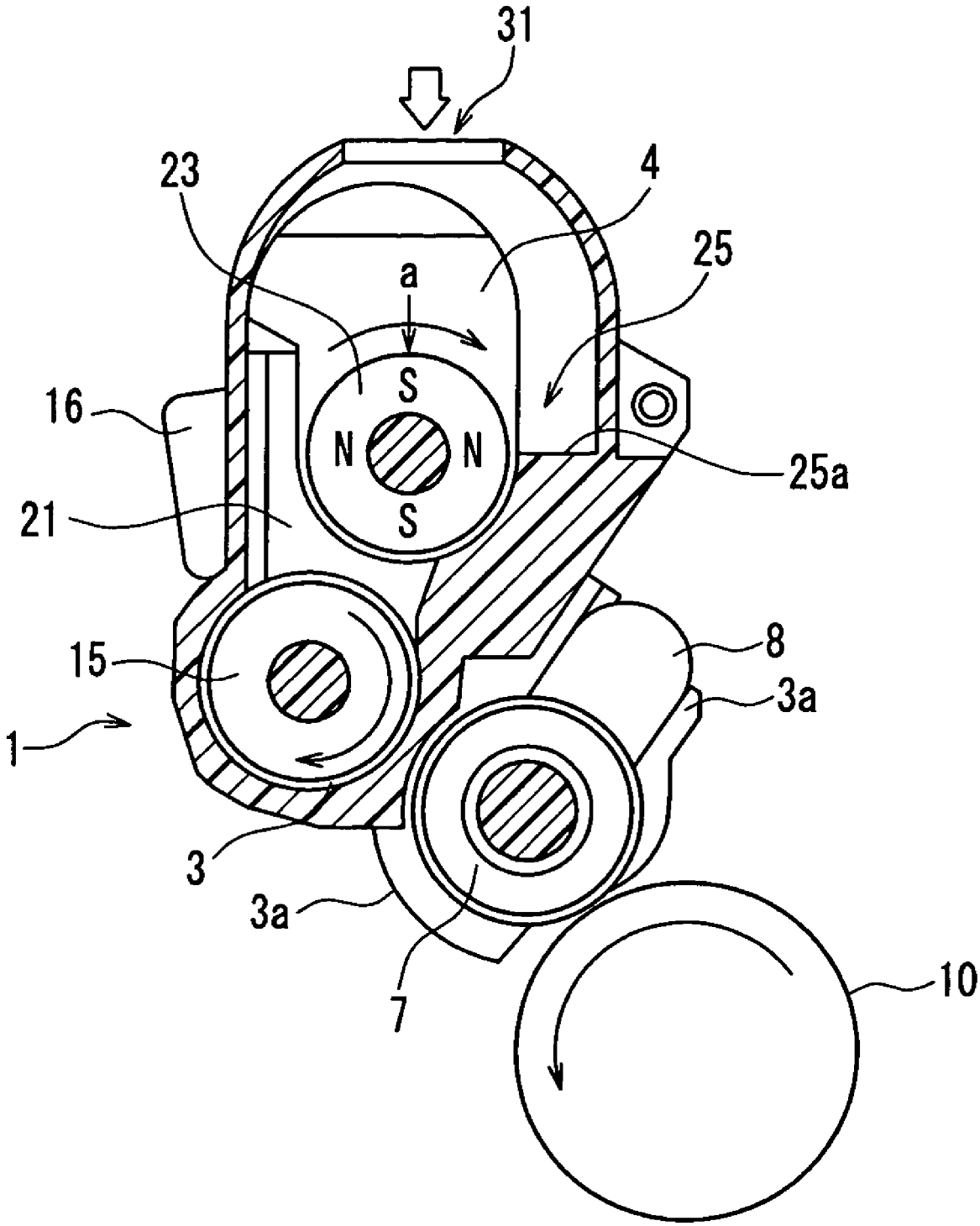
FIG. 8 is a cross-sectional view showing the relevant part of a developing apparatus according to Embodiment 6 of the present invention.

FIG. 8 shows a cross-sectional view of the relevant part of a developing apparatus according to Embodiment 6. FIG. 8 corresponds to a cross-sectional view taken along a line B-B in FIG. 2. The present embodiment is the same as Embodiment 1 except that the position of the toner replenishing port is different.

As shown in FIG. 8, the toner replenishing port 31 is formed above the magnet roller 23. A predetermined amount of toner is replenished via this toner replenishing port 31.

As in Embodiment 1, when the toner is consumed due to repeated development and thus the toner density in the developing apparatus is reduced to a predetermined value or less, this is detected by the sensor 16. In this case, a predetermined amount of toner is replenished into the upper developer transport path 4 from a toner cartridge (not shown) via the toner replenishing port 31, and thus a certain toner density is secured again.

According to Embodiment 6, the toner that newly has been replenished is supplied onto the magnet roller 23 on which a magnetic brush is formed. Thus, the toner that newly has been replenished is dispersed uniformly in the developer quickly because of a rotating action of the magnetic brush and a mixing action in the buffer space near the magnet roller 23. That is to say, the toner density in the apparatus can be stabilized at a certain value or more within a short period of time after the toner has been replenished, and thus a stable image quality can be maintained over a long period of time.

In particular, when a magnet roller having a non-magnetic sleeve made of aluminum or the like in which a plurality of magnetic poles is disposed is used as the magnetic roller 23 and a configuration in which only the sleeve is rotated or a configuration in which both of the magnetic poles and the sleeve are rotated at different peripheral velocities is employed, a new mixing action such as rotation of the magnetic brush on the sleeve is produced, so that the toner that newly has been replenished can be dispersed uniformly in the developer even more quickly.

Although various embodiments of the present invention have been described above, these embodiments are to be considered in all respects as illustrative. The invention should not be limited to these embodiments only, and various modifications and changes naturally can be made in the invention without departing from the technical idea of the invention.

The developing apparatus having a small size and employing a vertically circulating system of the present invention can be applied to electrophotographic image forming apparatuses such as copiers, facsimiles, and printers. Moreover, the developing apparatus also can be used for the purposes of, for example, forming a pattern on printed boards.

What is claimed is:

1. A developing apparatus comprising:

a rotatable electrostatic latent image holding member having a surface on which an electrostatic latent image is to be formed;

a developer holding member for supplying a developer comprising a toner and a carrier onto the surface of the electrostatic latent image holding member;

a first developer transport path that is disposed parallel to the developer holding member;

a second developer transport path that is disposed parallel to and below the first developer transport path;

communicating holes for communicating the first developer transport path and the second developer transport path with each other, the communicating holes being formed on both end portions of the first and the second developer transport paths;

first developer transporter for transporting the developer in a first direction, the first developer transporter being disposed in the first developer transport path;

second developer transporter for transporting the developer in a second direction that is opposite to the first direction and supplying the developer to the developer holding member, the second developer transporter being disposed in the second developer transport path;

a magnet roller for drawing up the developer that has been transported through the second developer transport path into the first developer transport path, the magnetic roller being disposed above one of the communicating holes that are disposed in the end portions; and an inclined surface that is disposed in contact with or close to a surface of the magnet roller and that is inclined such that the height thereof decreases along the first direction, wherein the developer that is held on the magnet roller is detached by the inclined surface, and the detached developer is transported in the first direction, and wherein a space in the first developer transport path that surrounds the magnet roller comprises a portion having a cross-sectional open area larger than that of a space in the first developer transport path that surrounds the first developer transporter.

2. The developing apparatus according to claim 1, wherein a space in the first developer transport path that surrounds the first developer transporter near the magnet roller comprises a portion having a cross-sectional open area larger than that of the space in the first developer transport path that surrounds the first developer transporter.

3. The developing apparatus according to claim 1, wherein the first and the second developer transporter are screws, and a transporting speed of the developer by the first developer transporter near the magnet roller is smaller than a transporting speed of the developer by the second developer transporter.

4. The developing apparatus according to claim 1, wherein the toner has a shape factor of at most 140.

5. The developing apparatus according to claim 1, wherein the carrier is a resin carrier containing a magnetic material, the surface of the resin carrier being coated with fluorine-modified silicone.

6. The developing apparatus according to claim 1, wherein the toner contains, as a lubricant, at least one or more metallic soaps of zinc stearate, calcium stearate, aluminum stearate, and magnesium stearate.

7. The developing apparatus according to claim 1, wherein a toner replenishing port is provided above the magnet roller.

* * * * *